United States Patent [19]

Funahashi

[11] 3,955,499

[45] May 11, 1976

[54] ROTARY RUBBER STAMP

[76] Inventor: Takaji Funahashi, No. 1, 2-Chome, Kitatakasho, Nishi, Nagoya, Aichi, Japan

[22] Filed: May 6, 1974

[21] Appl. No.: 466,867

[30] Foreign Application Priority Data

May 28, 1973 Japan ..... 48-63270[U]
Oct. 15, 1973 Japan ..... 48-119587[U]

[52] U.S. Cl. ..... 101/111
[51] Int. Cl.[2] ..... B41J 1/20
[58] Field of Search ..... 101/327, 328, 111, 333, 101/202, 105

[56] References Cited

UNITED STATES PATENTS

| | | | |
|---|---|---|---|
| 1,398,363 | 11/1921 | Cressler | 101/111 |
| 2,598,806 | 6/1952 | Lauer | 101/327 X |
| 2,853,002 | 9/1958 | Robinson | 101/327 X |
| 3,128,697 | 4/1964 | Clausing | 101/111 |
| 3,159,101 | 12/1964 | Dzickan | 101/111 |
| 3,402,663 | 9/1968 | Funahashi | 101/327 |
| 3,478,682 | 11/1969 | Funahashi | 101/327 |

*Primary Examiner*—Edgar S. Burr
*Assistant Examiner*—Edward M. Coven
*Attorney, Agent, or Firm*—Bucknam and Archer

[57] ABSTRACT

The invention discloses a rotary rubber stamp comprising a frame body with side openings, a bridge piece mounted to the lower ends of the frame body, rotary cylinders rotatably mounted nearly the center of the frame body, endless stamp belts made of porous rubber material containing continuous foam and mounted circularly around the rotary cylinders and the bridge piece, and rotary disks secured to the rotary cylinders and having their peripheral edges partially extend out of said openings, characterized by the provision of partition plates between the adjacent rotary disks and endless stamp belts.

1 Claim, 10 Drawing Figures

ROTARY RUBBER STAMP

BACKGROUND OF THE INVENTION:

This invention relates to a rotary rubber stamp and, more particularly, it relates to a rotary rubber stamp provided with rotatably mounted endless stamp belts made of porous rubber material containing continuous foam.

This kind of a rotary rubber stamp of the prior art comprises a frame body with side openings, a bridge piece mounted on the lower ends of said frame body, rotary cylinders rotatably supported nearly the center of the frame body, endless stamp belts made of porous rubber material having continuous foam and circularly mounted around said rotary cylinders and said bridge piece, and rotary disks secured to said rotary cylinders and positioned so as to have their peripheries partially lie out of said openings. With this kind of rotary rubber stamp, it is possible to stamp many times without using an ink pad at every stamping operation by having the endless stamp belt impregnated with ink in large quantity and also to stamp with various printing faces of the endless stamp belts by rotating said rotary cylinders by hand. However, there is a disadvantage that, since the sides of the ink impregnated endless stamp belts are always in contact with the said faces of said rotary disk, the ink stored in the endless stamp belts may get on the rotary disk and arrive at their peripheries with the result of staining the operator's hand when he rotated rotary disks.

It is also another disadvantage of this kind of rotary rubber stamp that, since the endless stamp belts are always partially exposed at the lower end of the rotary stamp, these exposed endless stamp belts may stain the desk or the operator's hand.

SUMMARY OF THE INVENTION:

It is an object of the invention to provide a rotary rubber stamp which can eliminate such disadvantages as mentioned above, precluding the danger of staining the desk or the operator's hand with ink.

In accordance with the invention, there is provided a rotary rubber stamp which comprises a frame body with side openings, a bridge piece held to the lower ends of said frame body, rotary cylinders rotatably supported nearly the center of said frame body, endless stamp belts circularly mounted around the rotary cylinders and the bridge piece and made of porous rubber material having continuous foam, rotary disks secured to said rotary cylinders and positioned so as to have the peripheries thereof lie partially out of said openings, characterized by the provision of partition plates between the rotary disks and the endless stamp belts adjacent thereto.

Also in accordance with the invention there is provided a rotary rubber stamp as specified above, further characterized by the provision of a frame sheath positioned below said frame body of the rotary rubber stamp and having a window opening through which the printing faces of the endless stamp belts can extend, and compression springs interposed between the frame body and the frame sheath for biasing said frame sheath downward to a position lower than those printing faces of the endless stamp belts positioned at the lower end of the frame body, said frame sheath being adapted to be raised to a position higher than such position of the printing faces as stated above.

Figure 1:
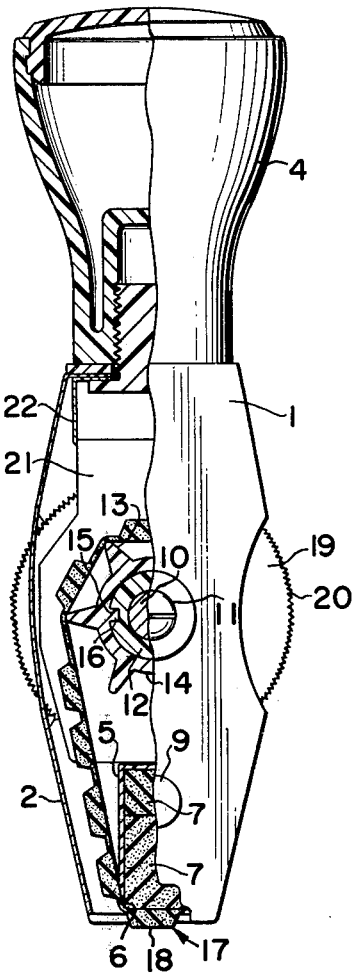
FIG. 1 is a side elevation, partially in longitudinal cross-section, of an embodiment of the rotary rubber stamp in accordance with the invention.

DESCRIPTION OF THE PREFERRED EMBODIMENTS:

Description will be made hereinbelow of the first embodiment of the invention with reference to FIGS. 1, 2 and 3.

The rotary rubber stamp comprises a frame body 1 covered on either side with a metal cover 2 which has a plurality of openings 3, 3 through which parts of the rotary disks to be later described may extend. A handle 4 is secured to the top of the frame body 1.

On the lower ends of the frame body 1 is mounted a bridge piece 5, which is of the shape of an inverted box with an opening 6 underside, and in the interior of which is held an ink storage means 7 made of porous, wear proof synthetic resin. The box-shaped bridge piece has in one side a hole 8 for replenishment of ink. In this hole 8 there is removably inserted a plug 9.

Nearly the center of the frame body 1 is mounted a fixed shaft 10 and secured by screws 11, 11. A plurality of short cylinders 12, 12 are rotatably mounted on the fixed shaft 10 and each of the short cylinders 12 is fitted with an engagement wheel 14 having on its periphery a plurality of slip preventive arms 13, 13. In the embodiment shown, that fitting is done by providing each short cylinder 12 with a key way 15 and providing each engagement wheel 14 with a key 16 which fits in the key way 15.

Around each engagement wheel 14 and the bridge piece 5 there is circularly mounted an endless stamp belt 17 made of porous rubber material having continuous foam, with a plurality of printing faces 18, 18 formed on the surface of each endless stamp belt 17.

Each short cylinder 12 is fitted integrally with a rotary disk 19 having peripheral serration 20 for antislip purposes parts of the periphery of rotary disks 19 project out of the openings 3, 3 of the metallic cover 2.

Between adjacent rotary disks 19 and endless stamp belts 17 there are placed partition plates 21 secured to the frame body 1 by means of a canopy plate 22 which serves also to support the metal covers 2. Adjacent partition plates 21, 21 may be connected by connection plate 23.

Figure 2:
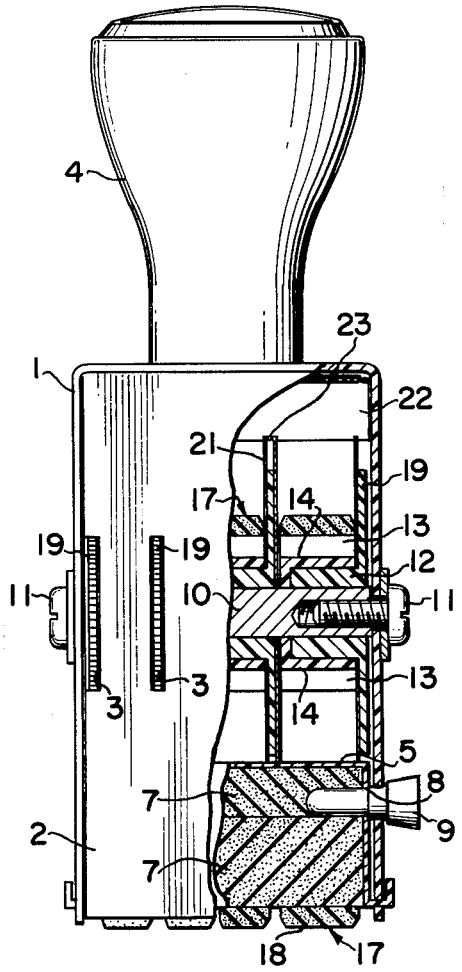
FIG. 2 is a front elevation, partially in longitudinal cross-section of the embodiment above.
Figure 3:
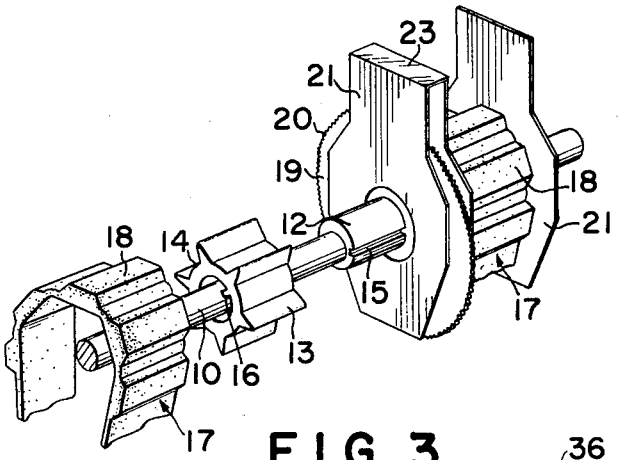
FIG. 3 is a brake down perspective view of parts of said embodiment.
Figure 8:
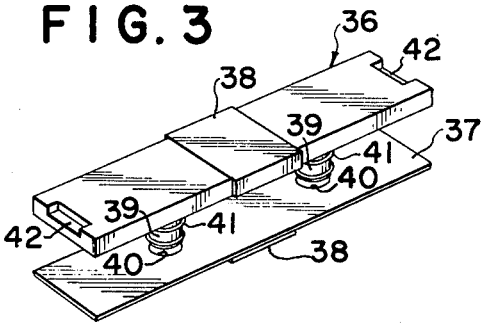
FIG. 8 is a perspective view of the girder, springs and head plate for the embodiment in FIG. 6.
Figure 9:
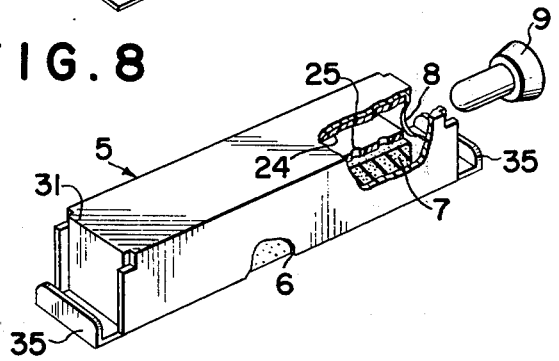
FIG. 9 is a perspective view of the bridge piece for the embodiment in FIG. 6.
Figure 10:
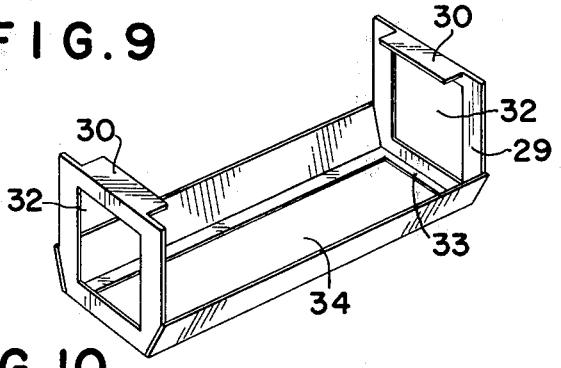
FIG. 10 is a perspective view of the frame sheath for the embodiment in FIG. 6.

As shown in FIGS. 1, 2 and 3, the cylinders 12 are rotatably mounted near the center of the frame body. Numeral 14 designates a plurality of wheels each mounted coaxially about the respective cylinder. The endless stamp belts are made of porous rubber material, and each belt is mounted around the bridge piece and is in engagement with the ink storage means and around the respective wheel. Each one of the rotary discs is secured to a respective cylinder and each disc is spaced from the wheel mounted about that cylinder. The rotary discs are so positioned as to have their peripheries partially projecting out of the side openings 3 so that the wheels and the belts can be rotated. The rubber stamp comprises a plurality of pairs of partition plates, with each pair surrounding a respective disc. One plate of each pair is positioned between the respective disc and the wheel which is rotated thereby, while the other plate of each pair is positioned between the respective disc and the wheel adjacent thereto which is not rotated thereby. The partition plates are secured to and inside the frame body 1. The sides of each of the wheels contact two adjacent partition plates. In this matter, each of the partition plates prevents the ink from the endless stamp belts from contaminating the respective rotary discs.

When a suitable quantity of ink is put into the ink replenishment hole 8 to impregnate the ink storage material 7 before hand, the ink occluded in the ink storage material 7 gradually invade the endless stamp belts 17 and eventually reaches the printing faces 18. It is therefore possible to do stamping by pressing the printing faces 18 against paper. Stamping with any desired printing faces 18 may be obtained by turning rotary disks 19 to move endless stamp belts 17 circularly around the engagement wheels 14 and the bridge piece 5 through the intermediary of short cylinders 12 and slip preventive arms 13.

Since the partition plates 21 are placed between the adjacent rotary disks 19 and endless stamp belts 17, not any ink from the endless stamp belts 17 may go out to contaminate the rotors 19. Accordingly, no contamination of hand occurs when rotating the rotary disks 19 by hand.

Figure 4:
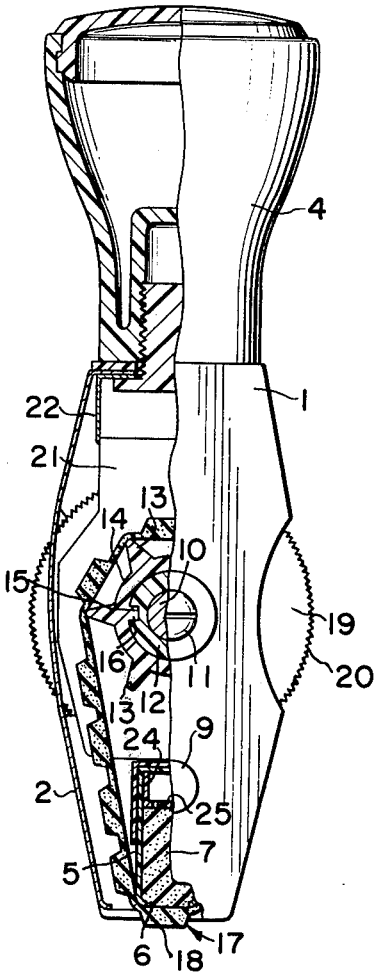
FIG. 4 is a side elevation, partially in longitudinal cross-section of another embodiment of the invention.
Figure 5:
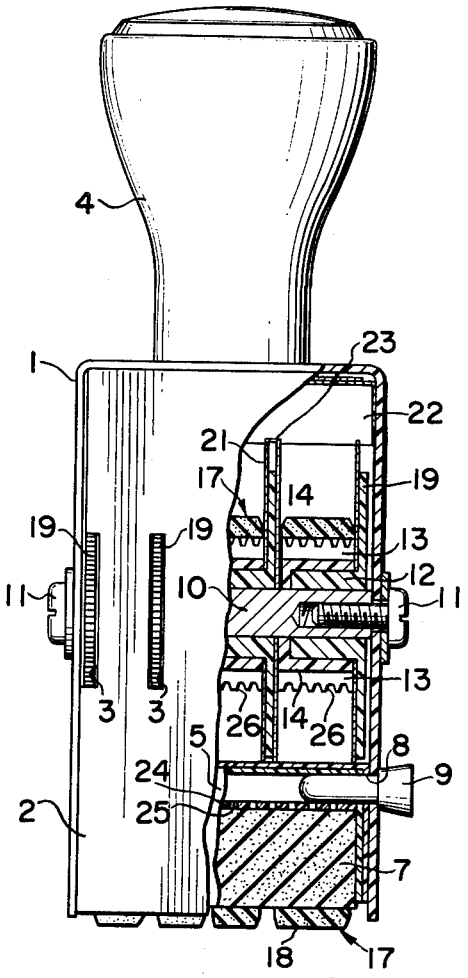
FIG. 5 is a front elevation, partially in longitudinal cross-section of the embodiment shown in FIG. 4.
Figure 6:
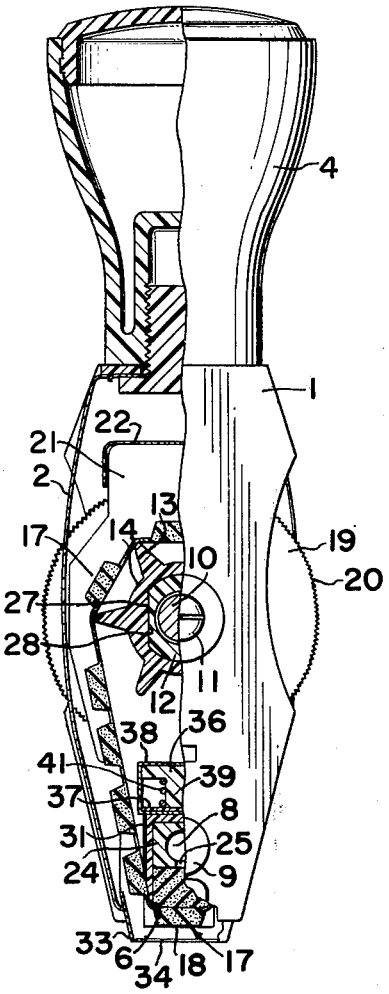
FIG. 6 is a side elevation, partially in longitudinal cross-section, of a further embodiment of the invention.
Figure 7:
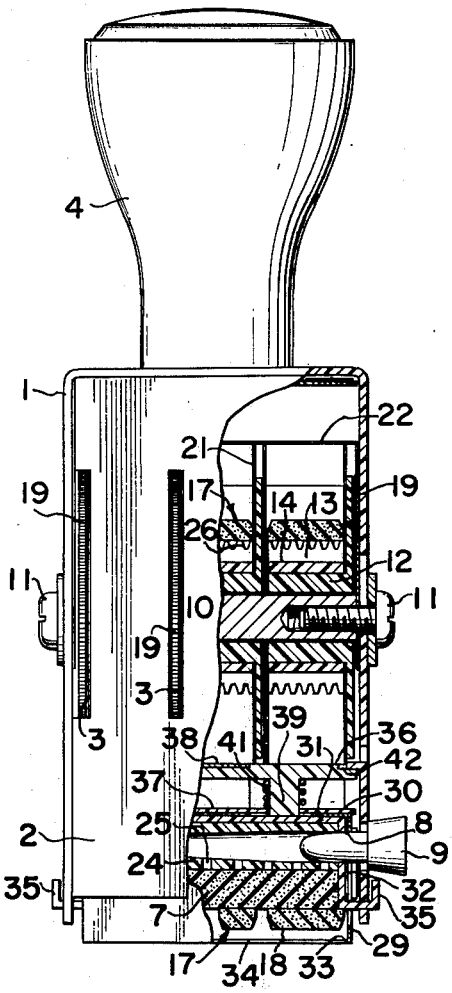
FIG. 7 is a front elevation, partially in longitudinal cross-section, of the embodiment shown in FIG. 6.

In the embodiment shown in FIGS. 4 and 5, there is provided an introduction case 24 positioned inside the box-shaped bridge piece 5 and over the ink storage material 7. The bottom of the introduction case 24 is provided with a plurality of ink inlet apertures 25. The introduction case 24 communicates at its one end with the hole 8 on one side of the bridge piece 5. Ink is fed from hole 8 into the introduction case 24 and goes through the ink inlet apertures 25 to the ink storage material 7 and is stored in it. The edge of the antislip arm 13 is serrated as at 26 for the purpose of preventing slip. Other details are the same as shown in FIGS. 1, 2 and 3.

In FIGS. 6, 7, 8, 9 and 10, which show another embodiment, a flat portion 27 is formed on one side of the periphery of the short cylinder 12, while the engagement wheel 14 has a flat portion 28 on one side of its inner surface, thereby both the flat portions 27 and 28 serving to engage the short cylinder 12 with the wheel 14. The lower ends of the box-shaped bridge piece 5 are provided with hooks 35, 35 projecting outward. The box-shaped bridge piece 5 is secured to the frame body 1 by fitting these hooks 35, 35 to the lower ends of the frame body 1. The box-shaped bridge piece 5 is covered by a frame sheath 29 having inwardly extending lugs 30, 30 at both upper ends, which rest on the upper end surfaces 31, 31 of the bridge piece 5. The frame sheath 29 has end openings 32, 32, through one of which is inserted a plug 9 into the hole 8.

The bottom plate 33 of the frame sheath 29 has window openings 34 through which the printing faces 18 of the endless stamp belts 17 may pass.

The hook 35, 35 projecting on both sides from the lower ends of the box-shaped bridge piece 5 are made to extend through the openings 32, 32 so that the frame sheath 29 may move up and down.

Above the box-shaped bridge piece 5 there is a girder 36 mounted on the frame body 1. A deck plate 37 is provided between the box-shaped bridge piece 5 and the girder 36. The deck plate 37 and the girder 36 are positioned in a ]-shaped holder frame 38. The deck plate 37 is set on the lugs 30, 30 of the frame sheath 29. Extending from the lower surface of the girder 36 are short studs 39, 39 which extend through guide holes 40, 40 formed in the deck plate 37. Compression springs 41, 41 are provided about the short studs 39 between the girder 36 and the deck plate 37.

The girder 36 has at both its ends recess 42, 42 which engage with protrusions 43, 43 provided on the inner surface of the side portions of the frame body 1 whereby to fix the girder 36 to the frame body 1.

The frame sheath 29 is normally pushed outward beyond the printing faces 18 of the endless stamp belts 17 by the compression springs 41, 41 through the intermediary of the deck plate 37 and therefore no contamination of hand or desks with the ink contained in the endless stamp belts 17 will take place. When it is desired to stamp, the frame sheath 29 is pushed inward against the action of the compression springs 41, 41 and the printing faces 18 of the endless stamp belts 17 pass through the window opening 34 of the frame sheath to expose themselves out so that stamping may be carried out.

I claim:

1. A rotary rubber stamp consisting of a frame body, a metal cover having side openings, an inverted U-shaped bridge piece mounted at the lower end of said frame body, ink storage means in the interior of said bridge piece, a plurality of cylinders rotatably mounted near the center of said frame body, a plurality of wheels each mounted coaxially about a respective one of said cylinders, a plurality of endless stamp belts made of porous rubber material, each of said belts being mounted around said bridge piece and being in engagement with said ink storage means and around a respective one of said wheels, a plurality of rotary discs each secured to a respective one of said cylinders, each said disc being spaced from the wheel mounted about said one cylinder, said rotary discs being so positioned as to have their peripheries partially projecting out of said side openings, to enable said wheels and belts to be rotated, and a plurality of pairs of partition plates, each pair surrounding a respective disc, one plate of each said pair being positioned between said respective disc and the wheel which is rotated thereby, the other plate of each said pair being positioned between said respective disc and the wheel adjacent thereto which is not rotated thereby, said partition plates being secured to and inside said frame body, the sides of each of said wheels contacting two adjacent partition plates whereby said partition plates prevent the ink from said endless stamp belts from contaminating the respective rotary discs.

* * * * *